US005684439A

United States Patent [19]

Vangala

[11] Patent Number: 5,684,439

[45] Date of Patent: Nov. 4, 1997

[54] HALF WAVE CERAMIC FILTER WITH OPEN CIRCUIT AT BOTH ENDS

[75] Inventor: Reddy R. Vangala, Albuquerque, N. Mex.

[73] Assignee: Motorola, Inc., Schaumburg, Ill.

[21] Appl. No.: 541,749

[22] Filed: Oct. 10, 1995

[51] Int. Cl.[6] ..... H01P 1/20

[52] U.S. Cl. ..... 333/202; 333/203; 333/206

[58] Field of Search ..... 333/203, 206, 333/207, 222, 223, 202, 202 DB

[56] References Cited

U.S. PATENT DOCUMENTS

| | | | |
|---|---|---|---|
| 4,431,977 | 2/1984 | Sokola et al. | 333/202 X |
| 5,023,579 | 6/1991 | Bentivenga et al. | 333/203 |
| 5,081,435 | 1/1992 | Yorita | 333/206 |
| 5,130,683 | 7/1992 | Agahi-Kesheh et al. | 333/203 |
| 5,170,141 | 12/1992 | Yamazaki et al. | 333/202 |
| 5,175,520 | 12/1992 | Inoue | 333/222 |
| 5,291,160 | 3/1994 | Ishikawa et al. | 333/202 |
| 5,489,882 | 2/1996 | Ueno | 333/206 |
| 5,525,946 | 6/1996 | Tsujiguchi et al. | 333/202 |

FOREIGN PATENT DOCUMENTS

| | | | |
|---|---|---|---|
| 74802 | 3/1989 | Japan | 333/202 DB |
| 205903 | 9/1991 | Japan | 333/206 |
| 6069703 | 3/1994 | Japan | 333/206 |

*Primary Examiner*—Benny Lee

*Attorney, Agent, or Firm*—Gary J. Cunningham

[57] ABSTRACT

A ceramic filter (100) with a transmission zero is disclosed. The filter (100) includes a block of dielectric material having top (102), bottom (104), and side surfaces (106, 108, 110 and 112), and having two or more metallized through-holes extending from the top to the bottom surfaces (102, 104), defining approximately half wave long resonators. The surfaces are substantially covered with a conductive material defining a metallized layer, with the exception that the top surface (102) is substantially uncoated, and with the additional exception that the bottom surface (104) is also substantially uncoated defining a filter with an open circuit at both ends. The filter (100) also has an input and an output (118, 120) and a mechanism or slot for electrically isolating successive resonators, extending about halfway between the top (102) and bottom surface (104). A filter constructed as detailed above, can have a higher Q value and lower insertion loss.

14 Claims, 2 Drawing Sheets

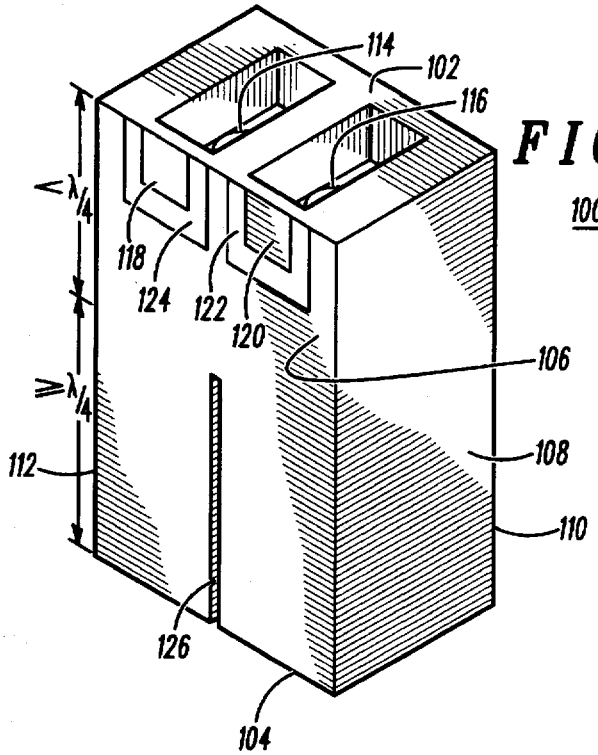
FIG.1
100
FIG.2B
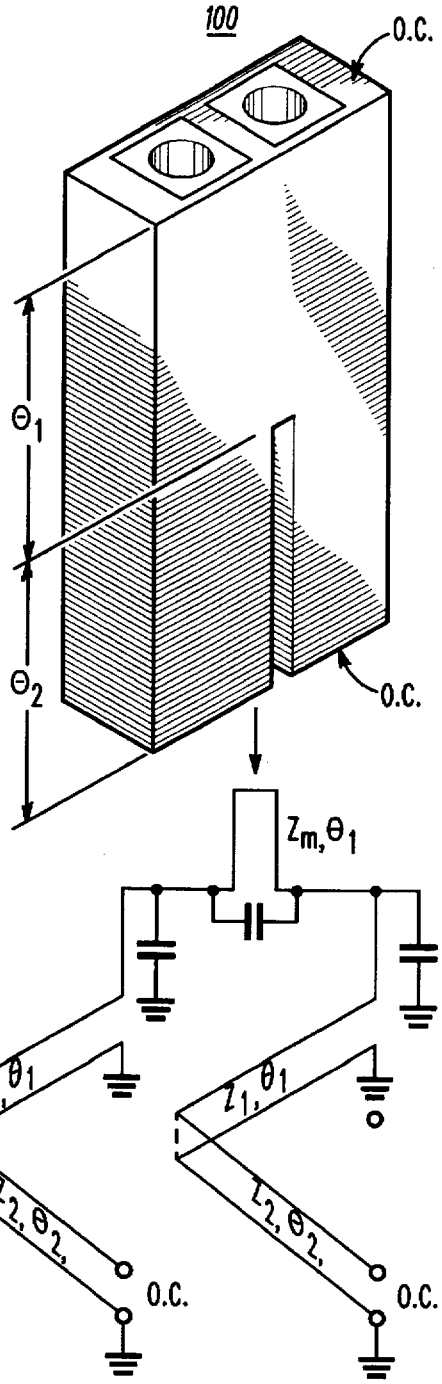
FIG.2A
—PRIOR ART—
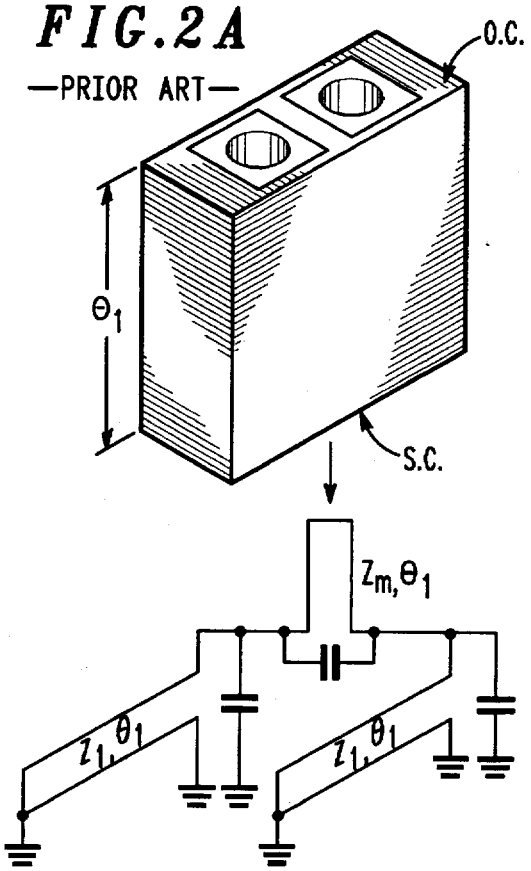

400

500

HALF WAVE CERAMIC FILTER WITH OPEN CIRCUIT AT BOTH ENDS

FIELD OF THE INVENTION

This invention relates to dielectric ceramic block filters and more particularly to a half wavelength ceramic filter with an open circuit at both ends.

BACKGROUND OF THE INVENTION

Ceramic filters which use quarter wavelength type resonators with one end open and the other end shorted to ground are well known in the art. Less common are half wavelength dielectric filters. Agahi-Kesheh et al, U.S. Pat. No 5,130,683, shows a Half Wave Resonator Dielectric Filter Construction having self-shielding top and bottom surfaces.

A trend in the industry is toward smaller filtering components that are required to operate and meet strict specifications at higher frequencies.

Typically, a minimum amount of volume of dielectric ceramic material is needed for a filter to have sufficient unloaded Q, a critical electrical property. Unfortunately, this presents a problem for designers who are increasingly being asked to reduce the thickness of the dielectric blocks in order to meet demanding specifications.

It would be advantageous to provide a block which offers a greater unloaded Q value and is thinner to allow a lower profile component on a circuit board, to be able to reduce certain dimensions and still get higher Q values from the filter.

This invention is uniquely adapted for high frequency filtering applications. For example, at PCS (personal communication system) frequencies of approximately 2000 MHz, it may prove useful to use a half wavelength ceramic filter as a way to increase the space available on the printed circuit board. Assuming that the same dielectric composition is used, a half wavelength ceramic filter can have a typical length of approximately 0.420 inches. Quarter wavelength ceramic filters in the cellular band of 900 MHz, on the other hand, are typically about one half an inch in length. Although the present invention adds length to the block, in certain applications it may actually reduce the overall space needed for filtering components.

This unique design offers many other advantages over prior art filters. Insertion loss values are improved dramatically when a half wavelength design is chosen. Also, the fact that the filter is open (unmetallized) at both ends can eliminate processing steps such as top printing or top metallization in those instances where a simple design is possible due to relaxed specifications.

A half wavelength ceramic filter with an open circuit at both ends which is able to offer higher Q values and lower insertion loss values in a low profile package which can operate at high frequencies, would be considered an improvement in the art.

BRIEF DESCRIPTION OF THE DRAWINGS

FIG. 1 is a perspective view of a half wavelength ceramic filter with an open circuit at both ends, in accordance with the present invention.

FIG. 2A shows a perspective view of a prior art quarter wavelength filter and a corresponding equivalent electrical schematic; FIG. 2B shows a perspective view of a half wavelength filter and a corresponding equivalent electrical schematic, in accordance with the present invention.

DETAILED DESCRIPTION OF THE PREFERRED EMBODIMENT

Figure 3:
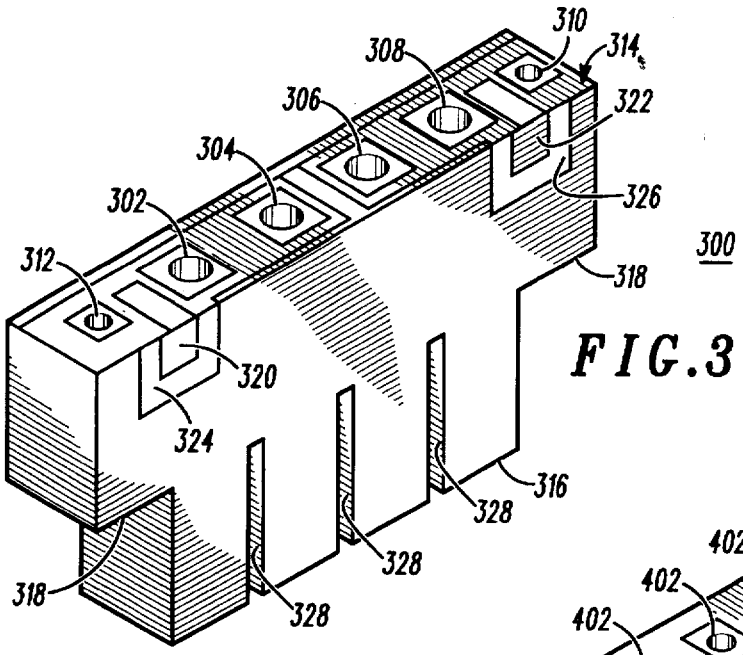
FIG. 3 shows an embodiment of a ceramic filter having both quarter wavelength and half wave resonators in a single block, in accordance with the present invention.

In FIG. 1, a half wavelength ceramic filter with an open circuit at both ends is shown. The filter (100) is a block of dielectric ceramic material having a top surface (102), a bottom surface (104), and four side surfaces (106, 108, 110, and 112). Throughholes (114, 116) extend from the top surface (102) to the bottom surface (104) of the block. The side surfaces (106, 108, 110, and 112) are covered with a conductive layer of material creating metallized surfaces. The top surface (102) and the bottom surface (104) of the block are unmetallized, creating electrical open ends on the block.

A first input-output pad (118) is located adjacent to a second input-output pad (120). Both input-output pads are immediately surrounded by an unmetallized or uncoated area of dielectric ceramic (122 and 124). Between the resonators (114 and 116), a metallized slot (126) extends from the bottom surface (104) of the block to a distance slightly greater than or equal to about a quarter wavelength or approximately halfway up the block.

In FIG. 1, the distance which the metallized slot (126) extends from the bottom surface (104) of the block is shown as the symbol ($\geqq\lambda/4$). The distance from the metallized slot (126) to the top surface (102) of the block is shown as the symbol ($<\lambda/4$).

The use of a half wavelength filter for certain telecommunication applications has both a practical and theoretical basis. On a practical side, the half wavelength filter can provide similar electrical characteristics as a quarter wave filter in a package which has a narrower profile and can be more easily designed into a circuit board design.

At a more theoretical level, the use of a half wavelength filter may actually lower the insertion loss of the filter. The insertion loss of any filter increases inversely with the unloaded Q factor of the resonators used in the filter. The unloaded Q of a ceramic resonator is proportional to the ratio of the volume of the dielectric ceramic block to the conductive metal surface area on the dielectric (ceramic) block. Some of the energy which is stored in the ceramic block is dissipated through the metal as ohmic loss. Ohmic loss is most severe near the short circuited end of a quarter wavelength resonator due to a higher current density. Since the proposed half wavelength filter is open at both ends, the ohmic loss is reduced leading to a higher unloaded Q factor and a lower insertion loss value for the filter.

A metallized slot is shown on the bottom half of the block in FIG. 1. The purpose of this slot is to electrically isolate the energy of one resonator from the energy of a second resonator in the slotted region. By placing the metallized slot between the resonators as is shown in FIG. 1, coupling from one resonator to the next is substantially minimized or prevented. The only critical parameter for this slot is that it be sufficiently thick so as to allow the interior surface of the individual resonators to be metallized. This same isolating effect could be achieved by other methods, such as embedding metal foil between the resonators, placing metallized holes between resonators, etc.

In FIG. 2, an equivalent electrical schematic of a prior art quarter wavelength filter (FIG. 2A) is compared to an equivalent electrical schematic of the present invention (FIG. 2B). Also in FIG. 2, "O.C." refers to an open-circuited end of the filter block and "S.C." refers to a short-circuited end of the filter block. In prior art quarter wave filters, the electrical length of the filter can be defined as "$\theta$". Prior art filters are often designed with "$\theta_1$", having a value which is slightly less than 90 degrees or slightly less than a quarter wavelength. By capacitively loading the top end of the filter by means of a printed pattern or a chamfer, balance of the quarter wavelength filter is achieved in the form of a true quarter wave filter having an electrical length of exactly 90 degrees. In the present invention, the short circuited end of prior art filters is simulated by the introduction of an additional 90 degree long (quarter wave) transmission line, or, in other words, by doubling the overall length of the dielectric block. In FIG. 2B, the additional length of transmission line is shown as "$\theta_2$". The filter (100) shows a block which is "$\theta_1+\theta_2$" in length and has an open circuit at both ends. By replacing the physical short circuit of the prior art with a simulated short circuit in the same plane, the ohmic loss and hence the insertion loss of the filter is reduced. However, in order to get the filter (100) to function properly, the coupling between the resonators along the additional 90 degree quarter wavelength transmission line portion of the block must be eliminated. This is best achieved by placing metallized slots between the resonators at one end of the block.

The prior art filter in FIG. 2A has an equivalent electrical schematic which shows two uncoupled transmission lines. Each transmission line has a characteristic impedance value of Z1 and an electrical length of "$\theta_1$. In the prior art filter, "$\theta_1$" has a value of approximately 90 degrees or one quarter wave length. In the schematic, the coupling between the resonators is represented by the transmission line of characteristic impedance Zm (mutual impedance) and electrical length "$\theta_1$".

The filter (100) depicted in FIG. 1 is also represented in FIG. 2 by an equivalent electrical schematic. By comparing the prior art schematic with the present invention schematic, a person skilled in the art would recognize that from an electrical point of view, the present invention is similar to the prior art. Of course, the present filter (100) offers the additional advantages of both lower insertion loss and a package with a lower profile when compared to the prior art filter.

When the filter (100) has an electrical length equal to ninety degrees ("$\theta_2$=90 degrees) and a characteristic impedance of Zm, an open circuit load will present a virtual short circuit at the junction of "$\theta_1$" and "$\theta_2$". This results in a mutual impedance value of Zm and the coupling between the two resonators remains unchanged.

When the filter (100) has an electrical length greater than ninety degrees ("$\theta_2$>90 degrees), there is a different electrical result. In this case, the net value of the mutual impedance, Zm, will be greater. This will result in reduced coupling between the resonators and ultimately a narrower passband width for the filter.

As can be seen from the schematics, when the bottom portion of the half wavelength resonators are separated in the manner detailed herein, the half wavelength filter behaves essentially as a quarter wavelength filter with a lower insertion loss value.

In FIG. 3, a single block (300) having both quarter wavelength and half wavelength resonators is provided. In this embodiment, the pole resonators (302, 304, 306, and 308) are a half wave in length and the trap or shunt zero resonators on the end of the block (310 and 312) are a quarter wave in length. The top surface (314) and the bottom surface (316) of the central portion of the block are substantially unmetallized or electrically open. The bottom surfaces of the quarter wavelength portion (318) of the filter, however, are metallized with a conductive material.

This filter (300) can also have two input-output pads (320 and 322) which are immediately surrounded by a respective uncoated or unmetallized area of dielectric material (324 and 326). Metallized slots (328) are placed between the resonators at the lower end of the block in order to electrically isolate the energy between the resonators.

The filter of FIG. 3 has various design characteristics that make this filter desirable for large volume production. Since the end resonators are quarter wavelength, the bottom surfaces of that part of the filter are shown grounded (metallized). This provides a convenient method of mounting this component in a test fixture. In such a fixture, the open ends of the filter can remain untouched by the test fixture device, which can result in greater throughput and faster tune rates leading to increased production rates.

FIG. 3 shows a multipole filter which employs both quarter wavelength and half wave resonators in the same dielectric ceramic block. In this embodiment, the end resonators may serve as shunt zeros or traps to provide steeper stopband attenuation without excessive roll-off at the bandpass edges of the filter response curve. Quarter wavelength resonators are sufficient for the shunt zeros, because they do not require as much unloaded Q as the pole resonators. Consequently, it may be desirable from a design perspective to construct a filter such as the one shown in FIG. 3 which will require less space on a circuit board than a complete half wavelength filter and still provide low loss and steep skirts on a filter response curve.

Although the embodiment shown in FIG. 3 shows the combined structure applied to a filter with shunt zeros, the concept of a combined quarter and half wavelength structure can also be used to construct all of the pole filters.

Figure 4:
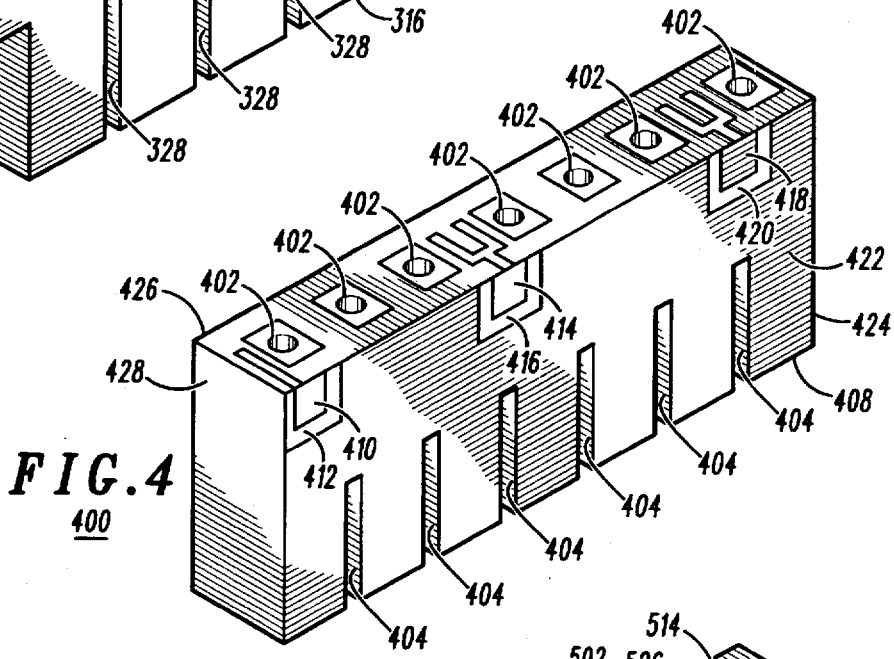
FIG. 4 shows a half wavelength ceramic filter with open circuit at both ends in the form of a duplexer filter, in accordance with thee present invention.

In FIG. 4, a duplexer including two half wavelength filters is shown. FIG. 4 shows that the present invention can be applied to duplex filters as well as simpler (in construction) filter structures.

In more detail, FIG. 4 shows a dielectric duplexer block of ceramic (400) having resonators (402) and metallized slots (404). The side surfaces of the block (422, 424, 426, and 428) are coated with a conductive material and the top surface (406) and the bottom surface (408) are uncoated or substantially unmetallized creating an electrical open circuit. This filter (400) has a first pad (410) which serves as an input pad for a transmit signal. The area (412) immediately surrounding the first pad (410) is uncoated or unmetallized. A second pad (414) serves as both an output pad for a transmit signal and an input pad for a receiving signal. The area (416) immediately surrounding the second pad (414) is uncoated or unmetallized. A third pad (418) serves as an output pad for a receiving signal. The area (420) immediately surrounding the third pad (418) is unmetallized or uncoated. When the filter is designed in this manner, a half wavelength duplexer filter is created.

Figure 5:
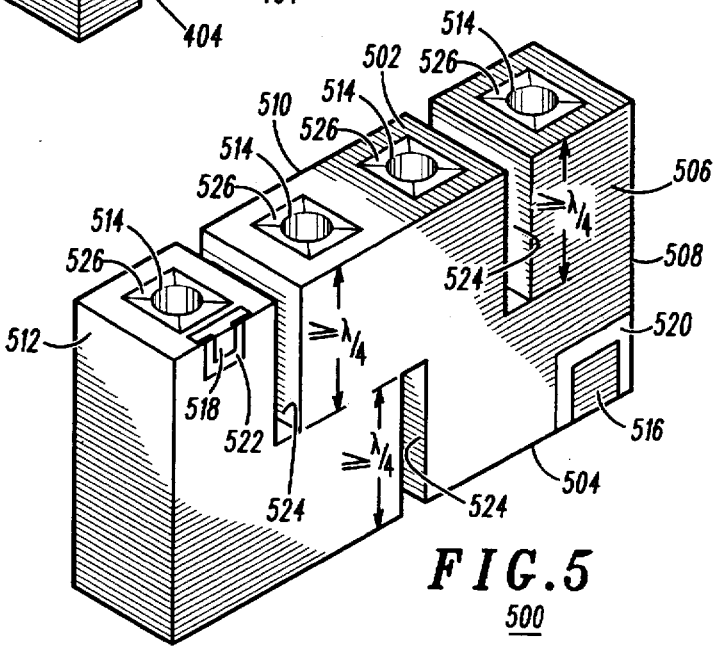
FIG. 5 shows another embodiment of the half wavelength ceramic filter with open circuit at both ends, in accordance with the present invention.

In the embodiment shown in FIG. 5, various aspects of the present invention are simultaneously presented. Since the filter is open at both ends, there is no criticality to keeping the input-output pads at any specific end of the block. The input-output pads could be placed at either end of the block as design specifications dictate, or, as is shown in FIG. 5, the input-output pads could be separated such that they are electrically isolated from each other with one on each end of the block. When the distance between the input and output (capacitive) pads is maximized by placing the pads nonadjacently rather than on the same edge of the block, the filter stopband attenuation is improved. Since both ends of the block in the present invention have a maximum electric field, the block filter can provide efficient capacitive coupling when the input and output pads are separated in this manner.

For the same reason, it is not critical that the metallized slots be always on the bottom surface of the block. FIG. 5 shows an embodiment where the isolating metallized slots between each pair of resonators originate at opposite ends of the block. Each metallized slot extends at least about a quarter wavelength deep, or about half way into the block. In FIG. 5, the distance which the metallized slots (524) extend from the top of the surface (502) and bottom surface (504) of the block is shown as the symbol ($\geqq\lambda/4$). This embodiment also shows chamfers at, at least one end of the resonators.

In more detail, FIG. 5 shows an embodiment of a dielectric ceramic block filter (500) having a top surface (502), a bottom surface (504), and four side surfaces (506, 508, 510, and 512). Through-holes (514) extend from the top surface (502) to the bottom surface (504) of the block. Input-output pads (516 and 518) are surrounded by respective unmetallized areas (520 and 522), and are located nonadjacently on the front surface (506) of the block. Metallized slots (524) originate from both the top surface (502) and the bottom surface (504) of the block. The area immediately surrounding the resonators (514) on the top surface of the block (502) has respective chamfers (526), to provide the desired capacitive loading.

Although various embodiments of this invention have been shown and described, it should be understood that various modifications and substitutions, as well as rearrangements and combinations of the preceding embodiments, can be made by those skilled in the art, without departing from the novel spirit and scope of this invention.

What is claimed is:

1. A half wave length ceramic filter with a transmission zero, comprising:

a filter body comprising a monolithic block of dielectric material and having surfaces including top, bottom, and side surfaces, and having a plurality of metallized through-holes extending from the top to the bottom surfaces defining a plurality of approximately half wavelength resonators, the side surfaces being substantially covered with a conductive material defining a metallized layer, the top surface and the bottom surface are substantially uncoated, defining a filter with an open circuit at opposite ends thereof, first and second input-output pads comprising a respective area of conductive material on at least one of the side surfaces and substantially immediately surrounded by a corresponding uncoated area of the dielectric material, the first and second input-output pads being capacitively coupled to corresponding ones of the plurality of resonators, and means for substantially isolating adjacent resonators having at least one metallized slot respectively between each adjacent resonator extending from one of the top and bottom surface, at least about one-quarter wavelength into the filter body.

2. The filter of claim 1, wherein the dielectric block has three input-output pads such that the first input-output pad provides an input for a transmit signal, the second input-output pad provides an output for a transmit signal and an input for a receiving signal, and a third input-output pad provides an output for a receiving signal, collectively defining a half wavelength duplex filter.

3. The filter of claim 1, wherein a desired capacitive loading of the resonators in proximity to the top surface is defined by a chamfer on the top surface.

4. The filter of claim 1, wherein said first and second input-output pads are placed substantially non-adjacently on the at least one of the side surfaces of the block, comprising the first input-output pad located in proximity to the top surface and the second input-output pad located in proximity to the bottom surface.

5. The filter of claim 1, wherein said means for substantially isolating adjacent resonators comprises a first metallized slot is located in proximity to the top surface and a second metallized slot is located in proximity to the bottom surface.

6. The half wave filter of claim 1, wherein a capacitive loading of the resonators in proximity to the top surface is defined by a printed pattern on the top surface being positioned a distance away from the resonator.

7. The filter of claim 1, wherein tuning regions at an end of said side surfaces allow said filter to be tuned to a higher frequency and tuning regions in a middle of said side surfaces allow said filter to be tuned to a lower frequency.

8. A half wave ceramic filter with a transmission zero, comprising:

a filter body comprising a monolithic block of dielectric material having surfaces including top, bottom, and side surfaces, and having a plurality of metallized through-holes extending from the top to the bottom surface, defining a plurality of approximately half wavelength resonators, the side surfaces being substantially covered with a conductive material defining a metallized layer, the top surface and the bottom surface are substantially uncoated, thereby defining a filter with an open circuit at opposite ends thereof;

first and second input-output pads comprising a respective area of conductive material on at least one of the side surfaces and substantially immediately surrounded by a corresponding uncoated area of the dielectric material, the first and second input-output pads being capacitively coupled to corresponding ones of the plurality of resonators; and the filter body having a plurality of metallized slots respectively between each adjacent resonator and parallel to the resonators and extending from at least one of the top and bottom surface at least one-quarter wavelength into the filter body.

9. The half wave filter of claim 8, wherein said dielectric block has three input-output pads such that the first input-output pad provides an input for a transmit signal, the second input-output pad provides an output for a transmit signal and an input for a receiving signal, and a third input-output pad provides an output for a receiving signal, collectively defining a half wavelength duplex filter.

10. The half wave filter of claim 8, wherein a desired capacitive loading of the resonators in proximity to the top surface is defined by a chamfer in the unmetallized area.

11. The half wave filter of claim 8, wherein said first and second input-output pads are placed in an isolated position on one of the side surfaces of the block, the first input-output pad is located in proximity to the top surface and the second input-output pad is located in proximity to the bottom surface.

12. The half wave filter of claim 8, wherein said plurality of metallized slots are placed on at least one of the side surfaces and comprise a first metallized slot located in proximity to the top surface and extending toward the bottom surface and a second metallized slot located in proximity to the bottom surface and extending toward the top surface.

13. The half wave filter of claim 8, wherein a capacitive loading of the resonators in proximity to the top surface is defined by a printed pattern on the top surface located a distance away from the resonators.

14. The filter of claim 8, wherein tuning regions at an end of said side surfaces allow said filter to be tuned to a higher frequency and tuning regions in a middle of said side surfaces allow said filter to be tuned to a lower frequency.

* * * * *